US005884791A

United States Patent [19]

Vohdin et al.

[11] Patent Number: 5,884,791

[45] Date of Patent: Mar. 23, 1999

[54] TELESCOPIC JIB FOR VEHICULAR CRANES

[75] Inventors: Kurt Vohdin, Zetal; Manfred Wilts, Schortens; Franz Paschke, Sande; Hans Neumann, Wangerland/Hooksiel; Jan Hinrichs, Schortens; Gerd Erdmann, Oldenburg, all of Germany

[73] Assignee: Kidde Industries, Inc., Shady Grove, Pa.

[21] Appl. No.: 878,100

[22] Filed: Jun. 18, 1997

[30] Foreign Application Priority Data

Jun. 18, 1996 [DE] Germany ..... 196 24 312.2

[51] Int. Cl.[6] ..... B66C 23/04

[52] U.S. Cl. ..... 212/348; 52/118

[58] Field of Search ..... 212/347, 348, 212/349, 350, 230, 231, 296; 52/118

[56] References Cited

U.S. PATENT DOCUMENTS

| | | | |
|---|---|---|---|
| 3,719,403 | 3/1973 | Sung | 212/350 |
| 3,931,698 | 1/1976 | Ebersold | 212/350 |
| 4,168,008 | 9/1979 | Granryd | 212/350 |
| 4,459,786 | 7/1984 | Pittman et al. | 212/348 |

FOREIGN PATENT DOCUMENTS

| | | | |
|---|---|---|---|
| 0668238 | 8/1995 | European Pat. Off. . | |
| 2681649 | 3/1993 | France . | |
| 2317595 | 10/1974 | Germany | 212/350 |
| 3015599 | 10/1981 | Germany | 212/350 |
| 3042993 | 7/1982 | Germany | 212/350 |
| 9210902 | 12/1992 | Germany . | |
| 9308993 | 8/1993 | Germany . | |

*Primary Examiner*—Thomas J. Brahan

[57] ABSTRACT

A telescopic jib includes a base part, and at least one telescopic part telescoped in the base part. A shift mechanism extends and retracts each telescopic part. The base part and each telescopic part includes an upper semi-box shaped section part, and at least one of the base part and the telescopic part includes a lower section part having shell segments adjoining each other. Each shell segment has an outwardly curved shape.

11 Claims, 4 Drawing Sheets

TELESCOPIC JIB FOR VEHICULAR CRANES

BACK GROUND OF THE INVENTION

1. Field of the Invention

The invention relates to a telescopic jib which is fittable particularly to vehicular cranes comprising a rotatively and slewably mountable base part in which several telescopic parts are located retractable and extensible.

2. Description of Related Art

Such telescopic jibs execute hoisting in the laden condition at their front end, the jib being exposed to a bending load in the two main axes, i.e. tensile stress existing on the upper side of the jib, whilst on the lower side compressive stresses occur. Due to lateral forces and eccentric loading, horizontal bending and torsion also occur.

Designers of such jibs are principally interested in optimally configuring the cross-section for telescopic parts loaded as such.

Such a cross-section is easiest to build when the maximum stresses are everywhere the same and approximate the permissible stress. These requirements are satisfied for instance in the case of thin-walled circular tubes or in the case of a square trussed structure when uniform forces materialize in different directions. If a cross-section is loaded, for instance, more in the vertical direction than in the horizontal, then an optimum round cross-section becomes an ellipse and a optimum cornered cross-section becomes a rectangular trussed structure; the cross-sections in both cases being higher than they are wide.

In the case of telescopic jibs which are employed in particular on vehicular cranes the loading is known, it being appropriate to configure the lower section part different from the upper since the stability of the former is more endangered.

A telescopic jib of the aforementioned kind is known for example from EP 0 499 208 B1. The cross-section of this telescopic jib consists of an upper section part having a semi-box shaped configuration and a lower section part, configured totally round as a half shell, welded to the free legs of the latter. Although such totally round lower section parts have good properties as regards load application and stability, they fail to achieve the stiffness afforded by rectangular trussed structures, it often being necessary to include additional members to promote stability such as welded stiffeners to counteract buckling or to configure the cross-section somewhat thicker which has a negative effect on the weight of the jib overall.

From EP 0 668 233 A1 a jib section for cranes and crane vehicles is known in which the two upper leg sections of the lower section, welded to the legs of the upper section, are configured as straight strips. The remainder of the lower section part has a curved shell shape. Also proposed as an alternative is to employ a straight section part at another point of the lower section part. These straight strip portions produce at their edges cross-sectional kinks in the section. Due to these kinks the loading properties of such a section again approach those of a rectangular trussed structure, and the stiffness can be increased. However, the drawback in such section designs is that, particularly due to the straight strips employed, the load application and stability properties, which are particularly favorable for curved sections, become poorer. On the other hand additional stiffeners or thick material gauges are needed, each of which increases the overall weight of the jib disadvantageously.

SUMMARY OF THE INVENTION

The object of the present invention is to provide a telescopic jib which avoids the aforementioned disadvantages of prior art. In particular it is intended to define a telescopic jib which combines the good load application and stability properties of curved sections with the higher stiffness of a rectangular trussed structure and thus can be built particularly lightweight.

This object is achieved according to the invention in that at least one of the base part and the telescopic parts comprise a lower section part consisting of several shell segments adjoining each other having an outwardly curved shape.

Due to this configuration of the lower section part, the good load application and stability properties of curved shells are combined with the high stiffness of trussed structures. Due to the resulting kinks at the edges of the shell segments, the buckling behavior can be improved. The shape of the individual shell segments, each curved outwardly, improves, in particular, the load application properties. A further advantageous effect of the curved shell segments is that, due to this shape, more material of the cross-section, particularly the kink points, receive a greater spacing to the axis through the center of gravity thereof which in turn increases the stiffness and the stability of the section.

Accordingly, the buckling strength of the telescopic jib according to the invention is enhanced with respect to the cross section of known sections.

Preferably the upper section part and the lower section part of a telescopic jib in accordance with the present invention are welded to each other by their adjoining legs.

In accordance with a preferred embodiment of the telescopic jib according to the invention the curved shell segments are configured in the shape of an arc. Such an approximate shape of an arc has good load application properties. To fabricate shell segments having the curvature of a circular arc in differing shapes, e.g. shield-shaped, the circular arc shell segments may have radii differing from each other; symmetrical sections being fabricated by circular arc shell segments each having the same radius arranged mirror inversely with respect to a vertical plane through the longitudinal center line.

The lower section part of a telescopic jib in accordance with the present invention consists of at least two curved shell segments. The number of the shell segments to be used depends, on the one hand, on the desired shape of the jib; and, on the other, on the loading cases anticipated. Preferably three, four or more shell segments may be used; in configuring a shield shape four curved shell segments being provided for example.

Telescopic jibs in accordance with the invention comprise shifting means for the telescopic parts which, depending on the case concerned, may be hydraulic piston/cylinder mechanisms or translated cable units.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will now be explained in more detail by way of example embodiments with reference to the enclosed Figures in which.

DETAILED DESCRIPTION OF THE PREFERRED EMBODIMENTS

Figure 1:
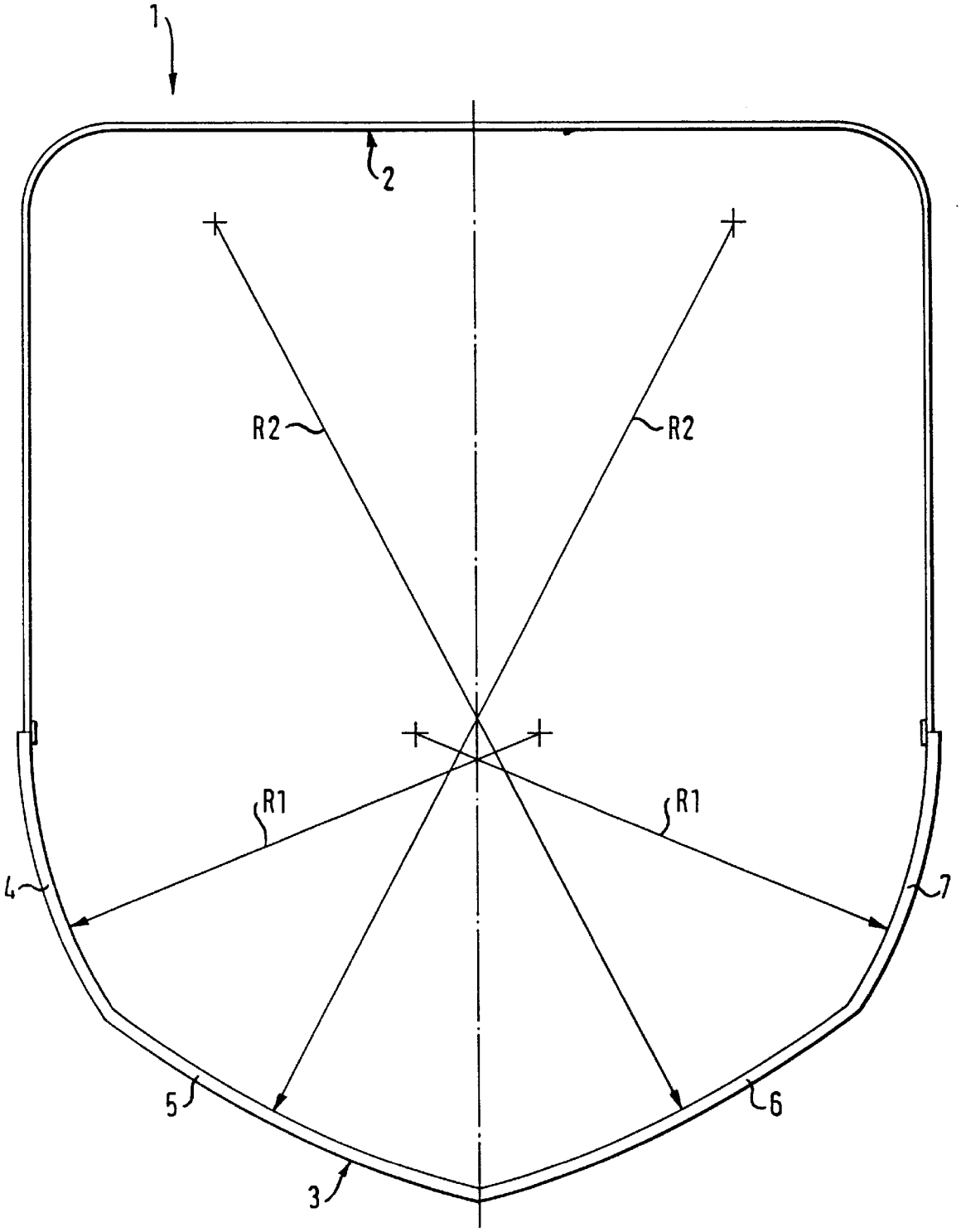
FIG. 1 shows a cross-section through a telescopic part of a telescopic jib in accordance with the invention.

The cross-section shown in FIG. 1 represents a telescopic part identified in total by the reference numeral 1. The telescopic part 1 consists of an upper semi-box shaped section part 2 and a lower section part 3 connected thereto by the legs thereof extending straight down. Particularly of interest in FIG. 1 is the configuration according to the invention of the lower section part 3. The lower section part 3 is made up of four curved shell segments 4, 5, 6 and 7 arranged symmetrically with respect to a vertical plane through the longitudinal axis as shown. Each of the section parts 4 and 7 or 5 and 6 have, mirror inversely, the same shape. In this example embodiment, the section parts 4–7 are curved in the shape of a circular arc, the section parts 4 and 7 each having the indicated smaller radius R1 and the section parts 5 and 6 each having the indicated greater radius R2. At the joining edges of the shell segments 4, 5, 6 and 7, the imaginary tangents intersect the circular arcs incident to each other at an obtuse angle in each case; kink edges being formed at the segment limits.

The aforementioned kink edges endow the lower section part 3, which in operation of the crane is subjected to compression and torsional loading, with stability properties as achieved only by trussed section structures as regards stiffness.

In the lower section part 3 no straight shell segments exist. The curved segments 4, 5, 6 and 7 each include the advantages of arced section portions of such jibs relative to, as already mentioned, favorable properties in the application of forces, resistance to buckling and a shift in the cross-sectional contours outwardly away from the axis of the center of gravity of the section which likewise has a favorable effect on the stability.

At the joining edges of the upper section part 2 and the lower section part 3 with the outer edges of the segments 4 and 7, the two section parts are connected to each other; this being done in particular by welding.

A telescopic jib configured in accordance with the embodiment as evident from FIG. 1 may be fabricated in a lesser material thickness due to its favorable stiffness and stability properties and its low tendency, as compared to configurations of prior art, to buckle in the compressive loading range. There is now practically no need for means promoting stability, such as the use of welded-on gussets and stiffeners to counteract buckling. This is particularly advantageous in that a low-weight jib can be fabricated.

Figure 4:
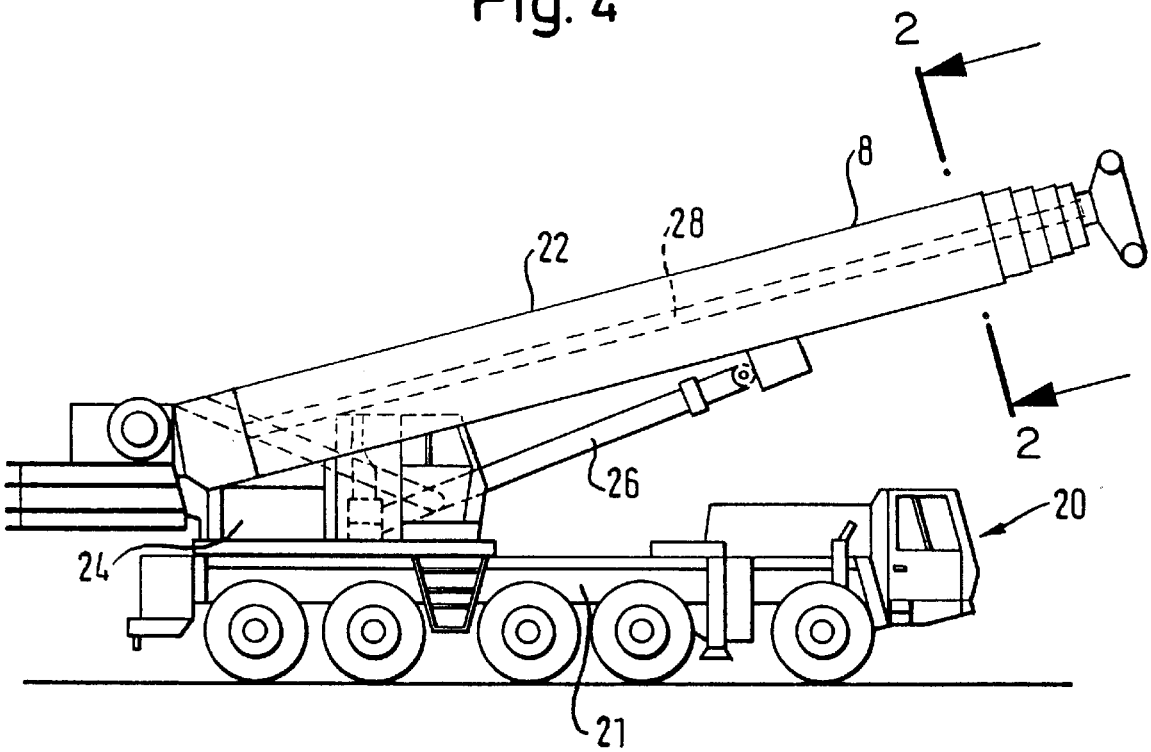
FIG. 4 is a side view of a crane having a telescopic jib with the cross-section shown in FIG. 2.

FIG. 4 illustrates a crane 20 having a retracted telescopic jib 22 according to the present invention. The telescopic jib 22 has one end mounted to a turntable 24, and the turntable is mounted to the superstructure 21 of the crane 20. A lift cylinder 26 raises and lowers the telescopic jib 22. The telescopic jib 22 includes a base part or section 8 and five telescopic parts or sections 1 telescoped one into the other. A shifting mechanism 28 extends and retracts the five telescopic parts 1. Specifically, the shifting mechanism 28 may be well-known hydraulic piston/cylinder units and/or translated cable units.

Figure 2:
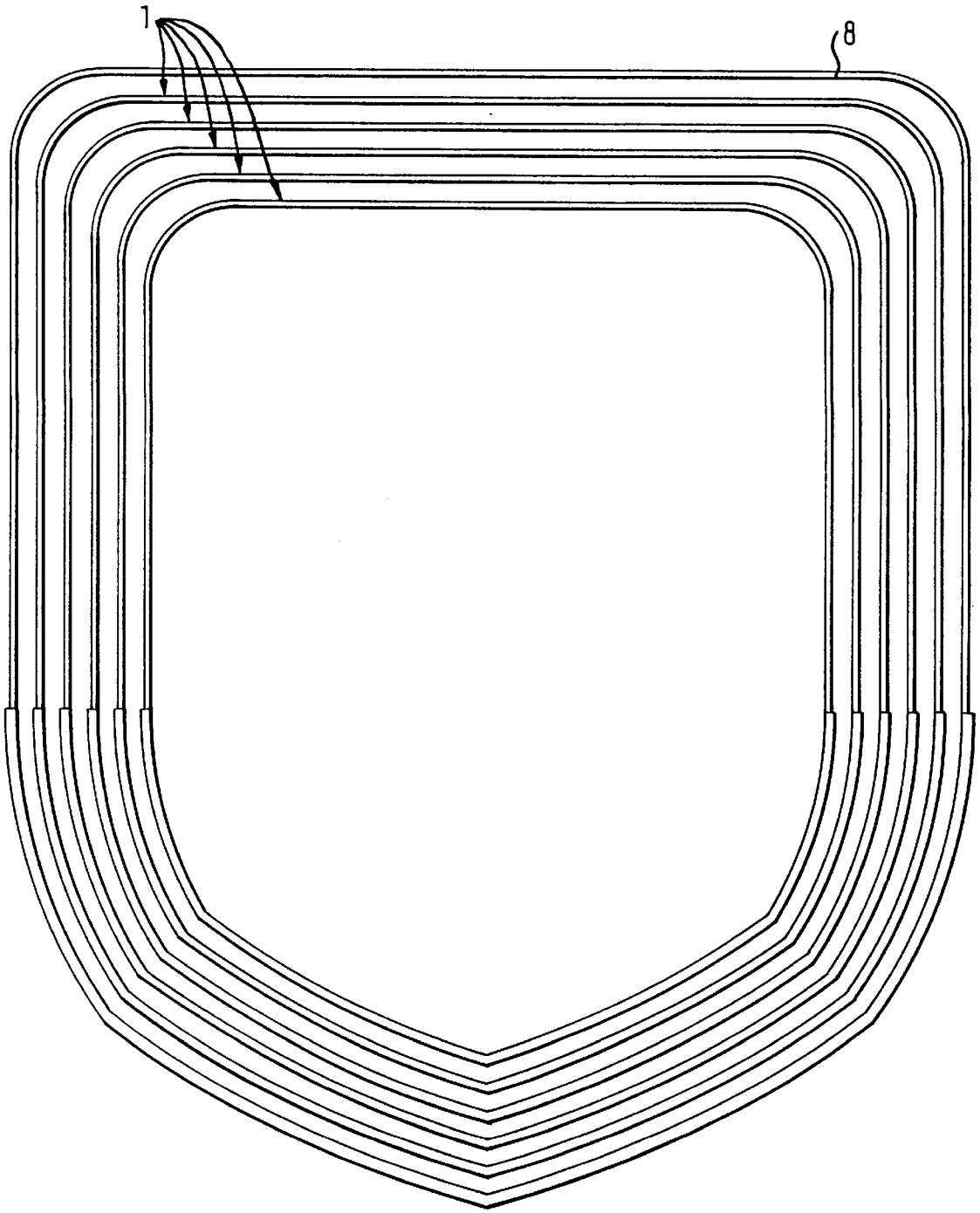
FIG. 2 shows a cross-section through a telescopic jib in accordance with the invention having a base part and five telescopic parts in the telescoped condition.

FIG. 2 shows a cross-section along line II—II of the telescopic jib 22 shown in FIG. 4. In this configuration both the base part 8 and the five telescopic parts 1 correspond to those of the embodiment shown in FIG. 1.

What is particularly evident from FIG. 2 is that the close arrangement of the telescopic parts 1 telescoped one into the other permits a more compact construction for jibs of this kind. The telescopic parts 1 and the base part 8, which may be mounted rotatable and slewable on a vehicle, are telescopable in particular with such a slight spacing from each other because for the aforementioned reasons that stiffening means, such as welded stiffeners to counteract buckling, can be eliminated and use can be made of thin wall thicknesses; thus resulting in a stable, lightweight telescopic jib.

While FIG. 2 illustrates the base part 8 and all five telescopic parts 1 as having a cross-section according to the present invention as exemplified in FIG. 1, the present invention is not limited to this arrangement. For instance, only the base part 8 could have the cross-section according to the present invention, or only one of the five telescopic parts 1 could have the cross-section according to the present invention. Namely, at least one of the base part 8 and the telescopic parts 1 has the cross-section according to the present invention.

Figure 3:
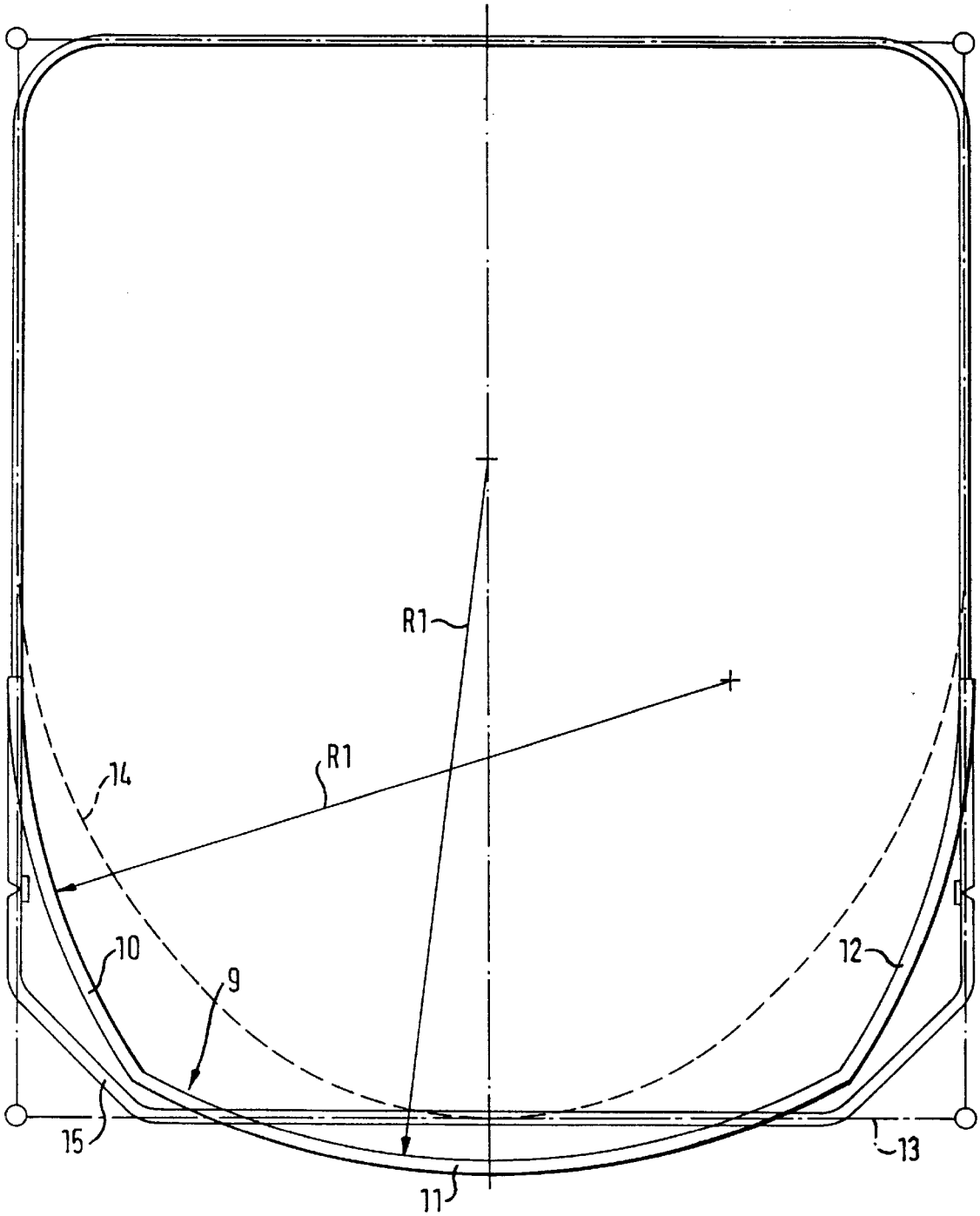
FIG. 3 is a combined view of various telescopic part cross-sections with a section in accordance with the invention having three curved shell segments in the lower section part.

FIG. 3 shows in conclusion a combined view of section shapes together with a cross-section representation of a telescopic part 9 in accordance with the invention having the curved shell segments 10, 11 and 12 which form the lower section part.

Indicated by dashes 14 is the extreme case of a purely arc-shaped lower section part as a semi-ellipse. As already mentioned, although this elliptical shape has the best properties as regards the application of forces, it has the inherent deficiencies of trussed shapes as regards stiffness. The rectangular trussed structure is represented also in FIG. 3 by the dot-dashed lines 13. As already mentioned, although such configurations feature a good stiffness, they have disadvantages as regards the application of forces.

The reference numeral 15 in FIG. 3 identifies a section shape which comprises bevels at the lower outer edges. Although this configuration represents a compromise between the "trussed structure" and the elliptical system, here too however, problems are still encountered as to the application of forces due to the straight segments.

The jib section according to the invention identified by the reference numeral 9 in FIG. 3 combines the positive force application properties of the arc shape with the stiffness of trussed structures. The embodiment represented in this case comprises three curved shell segments 10, 11, 12 in the shape of a circular arc, all three circular arcs having the indicated radius R1. As compared to the embodiment as shown in FIG. 1 a substantially planar contour materializes at the lowest point of the section in this configuration. Here too, the aforementioned advantages exist as regards force application, stiffness, resistance to buckling, and stability which characterize jibs according to the invention as compared to those of prior art.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A telescopic jib, comprising a base part;

at least one telescopic part telescoped in said base part;

a shift mechanism extending and retracting each telescopic part; and wherein said base part and each telescopic part includes an upper semi-box shaped section part; and at least one of said base part and said telescopic part includes a lower section part having at least two shell segments directly adjoining each other, through bends in the lower section part with no flat segments therebetween, each shell segment having an outwardly curved shape with a different axis of rotation, and wherein there are no flat segments in said lower section part.

2. The telescopic jib of claim 1, further comprising:

a plurality of telescopic parts telescoped one into another and into said base section; and wherein at least one of said base part and said telescopic parts includes said lower section part.

3. The telescopic jib of claim 2, wherein all said telescopic parts include said lower section part.

4. The telescopic jib of claim 1, wherein said lower section part is welded to a corresponding one of said upper section parts.

5. The telescopic jib of claim 1, wherein each shell segment has a circular arc shape.

6. The telescopic jib of claim 5, wherein at least two of said shell segments have circular arc shapes with different radii.

7. The telescopic jib of claim 1, wherein said lower section part has three shell segments.

8. The telescopic jib of claim 1, wherein said lower section part has four shell segments.

9. The telescopic jib of claim 1, wherein said shifting mechanism includes hydraulic piston/cylinder units.

10. The telescopic jib of claim 1, wherein said shifting mechanism includes translated cable units.

11. A crane, comprising:

a superstructure;

a turntable rotateably mounted to said superstructure;

a telescopic jib having one end pivotally mounted to said turntable, said telescopic jib including, a base part, at least one telescopic part telescoped in said base part, a shift mechanism extending and retracting each telescopic part, and wherein said base part and each telescopic part includes an upper semi-box shaped section part, and at least one of said base part and said telescopic part includes a lower section part having at least two shell segments directly adjoining each other, through bends in the lower section part with no flat segments therebetween, each shell segment having an outwardly curved shape with a different axis of rotation, and wherein there are no flat segments in said lower section part; and a lift cylinder for raising and lowering said telescopic jib relative to said superstructure.

* * * * *